US007204001B2

(12) United States Patent
Lin

(10) Patent No.: US 7,204,001 B2
(45) Date of Patent: Apr. 17, 2007

(54) ZIPPER PULL TAB

(75) Inventor: Shin-Fu Lin, Taipei (TW)

(73) Assignee: Paragon Luggage, Inc., Irvine, CA (US)

( * ) Notice: Subject to any disclaimer, the term of this patent is extended or adjusted under 35 U.S.C. 154(b) by 82 days.

(21) Appl. No.: 10/475,818

(22) PCT Filed: Apr. 27, 2001

(86) PCT No.: PCT/US01/13726

§ 371 (c)(1),
(2), (4) Date: Oct. 16, 2003

(87) PCT Pub. No.: WO02/087380

PCT Pub. Date: Nov. 7, 2002

(65) Prior Publication Data

US 2004/0117954 A1 Jun. 24, 2004

(51) Int. Cl.
*A44B 19/26* (2006.01)

(52) U.S. Cl. ..... 24/429

(58) Field of Classification Search ..... 24/429–431
See application file for complete search history.

(56) References Cited

U.S. PATENT DOCUMENTS

| | | | | | |
|---|---|---|---|---|---|
| 2,373,523 | A | * | 4/1945 | Winterhalter | 24/421 |
| 3,601,088 | A | * | 8/1971 | Lacam | 118/64 |
| 4,137,043 | A | * | 1/1979 | Bernier et al. | 8/444 |
| 4,251,582 | A | * | 2/1981 | Bernier et al. | 428/99 |
| 4,704,770 | A | * | 11/1987 | Minami et al. | 24/431 |
| 5,101,538 | A | * | 4/1992 | Dieter | 24/429 |
| 5,456,755 | A | * | 10/1995 | Oomori et al. | 118/704 |
| 5,658,679 | A | * | 8/1997 | Shiratori | 428/623 |

* cited by examiner

*Primary Examiner*—James R. Brittain
(74) *Attorney, Agent, or Firm*—Jack A. Kanz; Scott T. Griggs

(57) ABSTRACT

The surfaces of a metal pull tab which is hingedly secured to a metal bracket on a zipper slider and/or the surface of the bracket which engages the pull tab is covered by a non-metallic relatively soft coating which prevents wear caused by metal-to-metal contact between the pull tab and the bracket and reduces noise caused by free-swinging contact between the pull tab and the zipper or slider to which it is attached.

10 Claims, 2 Drawing Sheets

ZIPPER PULL TAB

BACKGROUND OF THE INVENTION

1. Field of the Invention

This invention relates to pull tabs for reversible closure mechanisms. More particularly, it relates to pull tabs for sliders and similar devices used for reversibly closing mechanisms such as zippers and the like which are used on portable enclosures such as handbags, luggage and similar articles.

2. Description of the Related Art

Many portable containers such as handbags, hand-carried luggage, soft-sided bags, wheeled luggage and the like contain compartments that are reversibly opened and closed by zippers. Most such containers include multiple compartments, each employing at least one zipper closure. Many of the zippers employ two slider closures so that the compartment may be opened from either end of the zipper.

Zippers conventionally comprise parallel interlocking members that are reversibly joined or separated by a slider which moves along the length of the parallel members. The slider usually includes a bracket, loop or the like extending from the outer face thereof to which a pull tab is attached. The pull tab usually comprises a loop or a substantially flattened body with a loop extending from one end thereof which is secured in the bracket on the slider. The pull tab is thus loosely but securely hingedly attached to the slider by the loop extending through the bracket on the slider and may be used to move the slider.

While the interlocking parallel members may be formed of various materials, zippers designed for heavy duty use such as in travel bags and the like usually employ a metal slider because of the stresses and wear forces encountered in repetitive use. The pull tab loop secured to the slider bracket is also exposed to repetitive stresses and is also usually made of lightweight metal such as aluminum or aluminum alloys.

For cosmetic purposes, the slider and pull tab are usually painted or cosmetically treated so that the zipper closure mechanism matches or complements the colors of the bag. However, the point of contact between the slider bracket and the hingedly attached pull tab is exposed to extremely high stresses and wear when the zipper is opened and closed. As a result, the cosmetic coating on the contacting surfaces is readily distressed, removed or otherwise disfigured, exposing bright metal wear surfaces. The bag on which the zipper is employed thus quickly assumes the undesirable look of a worn bag.

Many portable zippered containers such as travel bags and the like employ a number of zippers, each of which employs a pull tab with one end hingedly attached to the slider bracket. As a result, the pull tabs swing freely and make repetitive contact with the slider, the zipper members, the bag or each other, causing a noticeable jingling or clicking noise when the bag is moved. Thus a person carrying a travel bag with conventional zipper pull tabs generates a noticeable and often distracting and/or aggravating jingling noise with every step taken.

SUMMARY OF THE INVENTION

In accordance with the present invention direct metal-to-metal contact between the surfaces of the pull tab and the bracket on which the pull tab is hingedly mounted are protected by a coating of non-metallic material which is softer than the metal of the pull tab and the bracket. The non-metallic material is applied to the surfaces of the pull tab which engage the slider bracket and/or the surfaces of the bracket which engage the pull tab or both. By precluding direct metal-to-metal contact between the pull tab and the slider, discoloration or disfigurement resulting from wear on the engaging surfaces is totally prevented.

Since the non-metallic coating is softer than the metal of the pull tab or slider, noise caused by free-swinging contact between the pull tab and the slider, zipper, etc., is eliminated or substantially decreased. Thus coating of such parts in accordance with the invention substantially eliminates the jingling noise normally associated with movement of portable bags, wheeled luggage and the like and also prevents evidence of wear between the engaging surface of the slider and the pull tab.

BRIEF DESCRIPTION OF THE DRAWINGS

Various other features and advantages of the invention will become more readily understood from the following detailed description taken in connection with the appended claims and attached drawing figures in which:

DETAILED DESCRIPTION OF THE INVENTION

For purposes of this disclosure, the term "travel bag" is used to mean any portable container with a reversible closure such as a zipper or the like. Similarly, "zipper" is used to mean any mechanism in which interlocking members arranged on opposite sides of an opening are reversibly joined or separated by a slider which is moveable along the interlocking members to close or open the opening.

Figure 1:
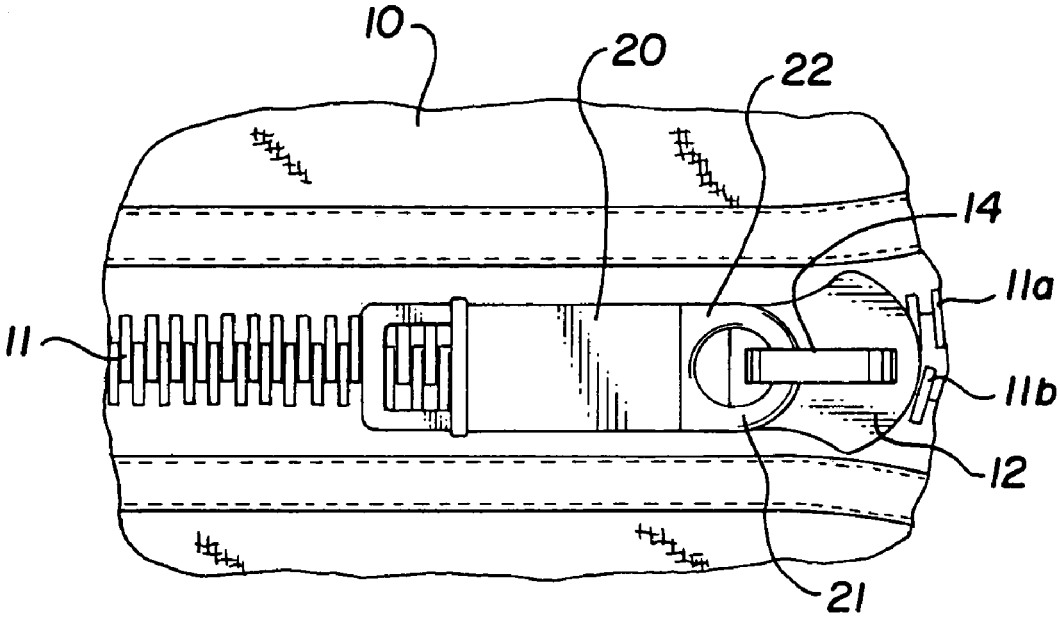
FIG. 1 is a fragmentary top plan view of a travel bag employing a closure zipper that includes a pull tab with a protective coating in accordance with the present invention.
Figure 4:
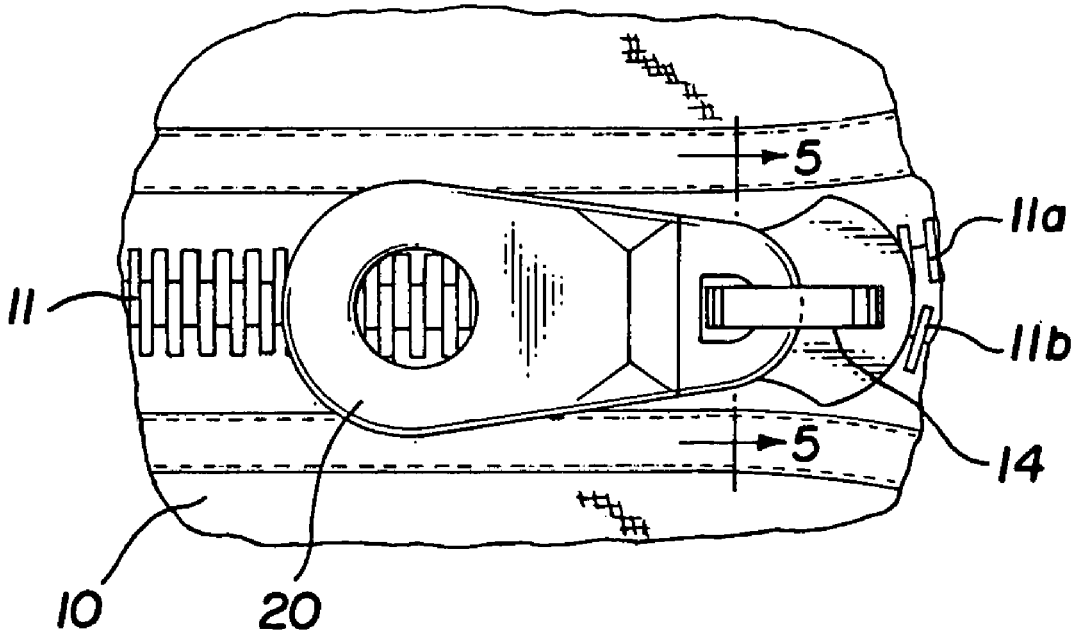
FIG. 4 is a fragmentary top plan view of a travel bag or the like employing a closure zipper with a pull tab of alternative design in which the contacting surfaces of both the pull tab and the slider bracket are coated in accordance with the invention.

In FIG. 1 and FIG. 4 a travel bag 10 is illustrated which employs a zipper 11. The zipper 11 comprises parallel interlockable members 11*a*, 11*b* secured to opposite sides of an opening in the bag. The parallel members are alternatively joined (to close the bag 10) or separated (to open the bag 10) by a slider 12 that is moveable along the length of the zipper 11. A loop or bracket 14 with an opening 13 therein is mounted on the exposed surface of the slider for moving the slider 12.

An elongated pull tab 20 having a loop 21 on one end thereof is hingedly secured to the slider 12 with the loop 21 passing through the opening 13 in the bracket 14. The pull tab 20 is thus used to pull the slider 12 in either direction to close or open the zipper 11.

Figure 2:
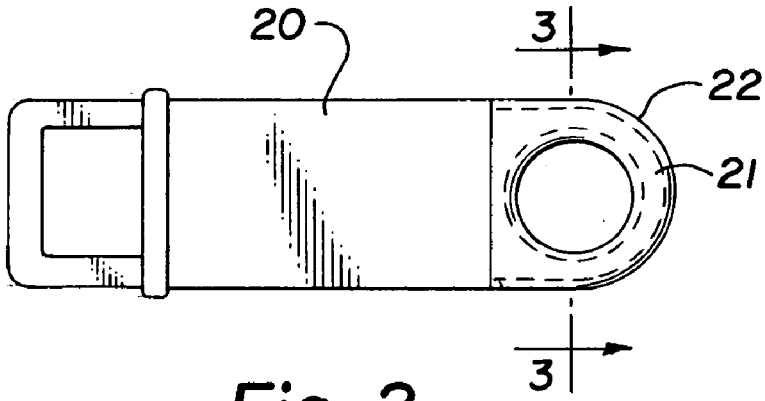
FIG. 2 is a top plan view of the zipper pull tab shown in FIG. 1 illustrating the protective coating in phantom.
Figure 3:
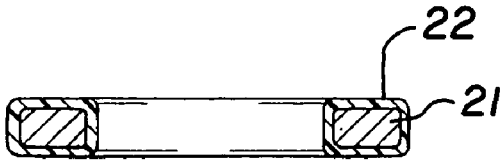
FIG. 3 is a sectional view of the pull tab of FIG. 2 taken through line 3—3.

As more clearly illustrated in FIG. 2 and FIG. 3, the loop 21 is covered with a coating 22 that prevents metal-to-metal contact between the loop 21 and the bracket 14 or any other portion of the slider 12.

As illustrated in FIGS. 1–3, the coating 22 is only applied to the loop 21 portion of the pull tab 20. In the embodiment shown in FIG. 4, the coating 22 is applied to the entire surface of the pull tab 20. When the coating 22 is applied to the entire pull tab as shown in FIG. 4, noise generated by contact between the pull tab 20 and any metal surface, such as the zipper 11, is avoided or substantially muted. Furthermore, the color of the coating 22 may be made to match or complement the color of the bag 10.

Figure 5:
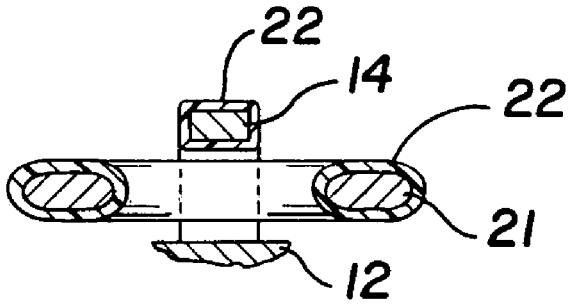
FIG. 5 is a fragmentary sectional view of the slider bracket of FIG. 4 taken through line 5—5.

Since one purpose of the coating 22 is to prevent noise generated by metal-to-metal contact between the loop 21 of the pull tab 20 and the bracket 14 on the slider, the coating may also be applied to the bracket 14. As shown in FIG. 4 and FIG. 5 the coating 22 may be applied to all surfaces of the bracket 14 that contact the pull tab, thus preventing metal-to-metal contact between the pull tab 20 and the slider 12. If desired, the coating 22 may be applied to both the slider and the pull tab as shown in FIG. 4 and FIG. 5.

Since one function of the coating 22 is to prevent generation of noise by metal-to-metal contact when a free-swinging pull tab contacts another metal surface, the coating must be softer than the metal surfaces which it contacts. However, the coating 22 must be tough enough to resist wear, tear and/or discoloration resulting from repeated stresses applied thereto during use to open and close the zipper 11. The coating 22 must also be tightly bound to the surface to which it is applied.

Various materials have been found suitable. Coatings or thick films of plastic materials such as polyethylene, polypropylene, ABS plastic, polyvinylcholride, plasticized rubber and the like are particularly suitable. It is only essential that the coating 22 be softer than the metal surface with which it makes contact; thick enough to provide a degree of resilience; and tough enough to withstand the stress and wear forces encountered in opening and closing the zipper without fracturing, tearing, discoloration, disfigurement, peeling or otherwise showing evidence of wear on the contacting surfaces.

The coating 22 may be applied by any of a variety of conventional techniques such as dipping, spraying and the like. In the presently preferred embodiment of the invention, the non-metallic coating is formed onto the metal part by molding. Various other conventional processes may be used, depending on the material of the coating, the thickness of coating to be applied, etc.

If desired, the portion of the pull tab 20 to which the coating is to be applied may be formed with reduced dimensions. Thus, when the coating 22 is applied the pull tab assumes uniform dimensions which conceal or camouflage the existence of the coating. For example, in FIGS. 1–3 the metal of loop portion 21 is formed in dimensions reduced by the thickness of the coating to be applied so that when coating 22 is applied the width of tab 20 appears uniform.

The coating 22 may be substantially transparent so that its presence is not particularly noticeable. Alternatively, the coating may be colored as desired to match, contrast with or complement the color or colors of the bag, the zipper or other portions of the pull tab.

Coatings 22, applied as described above, may be as thin as one millimeter or less or as thick as ten millimeters or more, depending on the composition of the coating, the size of the coated components and the anticipated stresses to be applied to the coated parts. Coatings applied to pull tabs and/or sliders as described above substantially eliminate the noise generated by free-swinging pull tabs and preserve the original appearance of the sliders and tabs by preventing noticeable wear.

Although the foregoing description refers in particular to travel bags and the like that employ a single zipper with a single slider, the invention is not so limited. The principles described may be readily applied to various portable containers that employ multiple zippers or zippers that employ multiple sliders, such as handbags, hand-carried luggage, soft-sided bags, wheeled luggage and other such containers that are reversibly opened and closed by zippers.

I claim:

1. A portable container having an opening therein, said portable container comprising:

(a) a pair of parallel interlocking zipper members, one arranged on each side of the opening in the container;

(b) a slider moveable along the zipper members for reversibly opening and closing the opening;

(c) a metal bracket extending from the moveable slider for hingedly supporting a pull tab;

(d) a metal pull tab for moving the slider, the metal pull tab including a metal loop that is integrally formed from the metal pull tab such that the metal loop includes reduced dimensions compared to the metal pull tab, the metal loop extending through the metal bracket to hingedly secure the metal pull tab to the metal bracket; and (e) a non-metallic coating secured to the metal loop such that the metal pull tab is exposed, the non-metallic coating providing for metal-to-non-metallic coating contact between the metal bracket and the metal loop, wherein the metal pull tab and the non-metallic coating secured to the metal loop define a tab having an apparent uniform width.

2. The portable container as defined in claim 1, wherein the nonmetallic coating is softer than the metal to which it is applied.

3. The portable container as defined in claim 1, wherein the dimensions of the surface of the metal loop which are covered by the coating are reduced by a thickness substantially equivalent to the thickness of the coating applied thereto.

4. The portable container as defined in claim 1, wherein the coating is substantially transparent.

5. The portable container as defined in claim 1, wherein the coating is colored.

6. The portable container as defined in claim 1, wherein the coating is (i) sufficiently thick and tough to resist visible wear when by contact with the slider; and (ii) softer than the metal of the slider.

7. The portable container as defined in claim 1, wherein the nonmetallic coating is formed by molding.

8. A method for precluding disfigurement of a zipper, the method comprising:

(a) providing a slider having a metal bracket extending there from;

(b) providing a metal pull tab including a metal loop of reduced thickness as compared to the metal pull tab, the metal loop, once assembled, extending through the bracket;

(c) selecting a coating technique from a group consisting of molding, dipping, and spraying;

(d) securing a non-metallic coating to the metal loop using the selected coating technique such that the metal pull tab is exposed and the metal pull tab and the nonmetallic coating secured to the metal loop define a tab having an apparent uniform width; and (e) hingedly securing the metal pull tab to the bracket in a process of assembling the zipper.

9. The method as recited in claim 8, further comprising preventing metal-to-metal contact between the bracket and the pull tab.

10. The method as recited in claim 8, further comprising providing for metal-to-non-metallic coating contact between the bracket and the pull tab.

* * * * *